US006883991B2

(12) United States Patent
Gueret

(10) Patent No.: US 6,883,991 B2
(45) Date of Patent: Apr. 26, 2005

(54) DEVICE, SYSTEM, AND METHOD FOR APPLYING A PRODUCT

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 10/271,946

(22) Filed: Oct. 17, 2002

(65) Prior Publication Data

US 2003/0086742 A1 May 8, 2003

(30) Foreign Application Priority Data

Oct. 17, 2001 (FR) ..... 01 13379

(51) Int. Cl.[7] ..... S45D 33/00; A46B 11/00; B43M 11/06; B43K 5/00

(52) U.S. Cl. ..... 401/130; 401/126; 401/123; 401/124; 401/183; 401/205

(58) Field of Search ..... 401/130, 126, 401/123, 124, 125, 118, 290, 23, 24, 18, 183, 205; 132/317

(56) References Cited

U.S. PATENT DOCUMENTS

| | | | | |
|---|---|---|---|---|
| 3,756,732 A | | 9/1973 | Stöffler | |
| 4,050,826 A | | 9/1977 | Berghahn et al. | |
| 4,780,361 A | * | 10/1988 | Schlein | 428/287 |
| 4,859,102 A | * | 8/1989 | Chamieh | 401/17 |
| 5,312,197 A | * | 5/1994 | Abramson | 401/6 |
| 5,322,382 A | | 6/1994 | Hull et al. | |
| 5,547,302 A | * | 8/1996 | Dornbusch | 401/172 |
| 6,019,537 A | * | 2/2000 | Hunt | 401/203 |
| 6,398,440 B1 | * | 6/2002 | Hills | 401/130 |
| 2001/0033766 A1 | | 10/2001 | Gueret | |

FOREIGN PATENT DOCUMENTS

| | | |
|---|---|---|
| DE | 37 11 890 | 10/1988 |
| DE | 200 13 013 | 3/2001 |
| EP | 0 680 706 | 11/1995 |
| FR | 2 805 720 | 9/2001 |

OTHER PUBLICATIONS

English language Derwent Abstract EP 0 680 706.*

English language Derwent Abstract of DE 37 11 890, Oct. 27, 1988.

English language Derwent Abstract of DE 200 13 013, Mar. 22, 2001.

* cited by examiner

*Primary Examiner*—David J. Walczak
(74) *Attorney, Agent, or Firm*—Finnegan, Henderson, Farabow, Garrett & Dunner, LLP

(57) ABSTRACT

A device for applying a product may include a first element configured to apply a product. The first element may at least partially include porous material. The device may include a second element, and a fixing element configured to removably affix the first element to the second element such that when the first element is separated from the second element, at least a substantial portion of the fixing element remains on the second element.

37 Claims, 5 Drawing Sheets

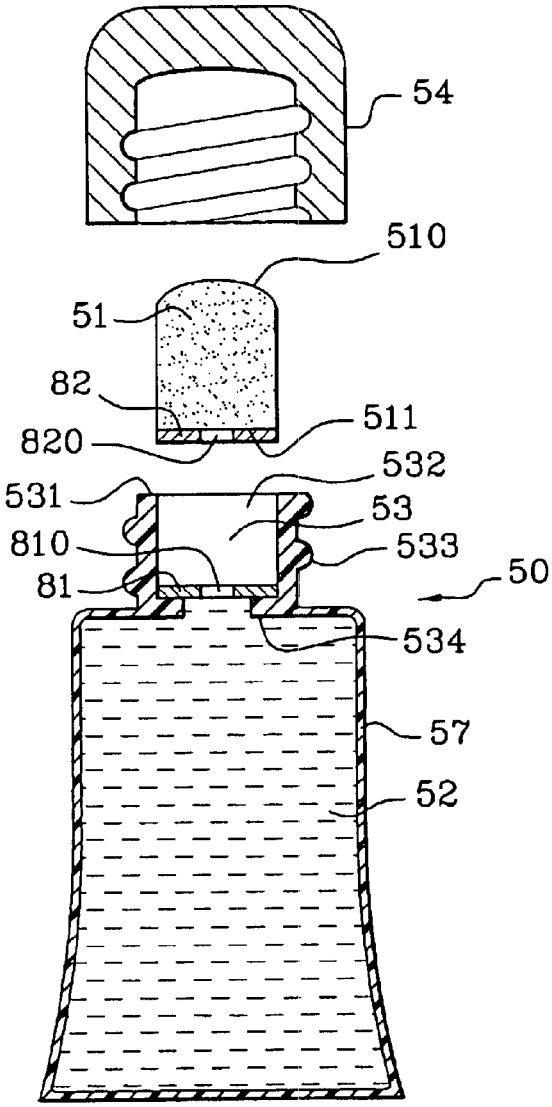
Fig. 10
Fig. 9
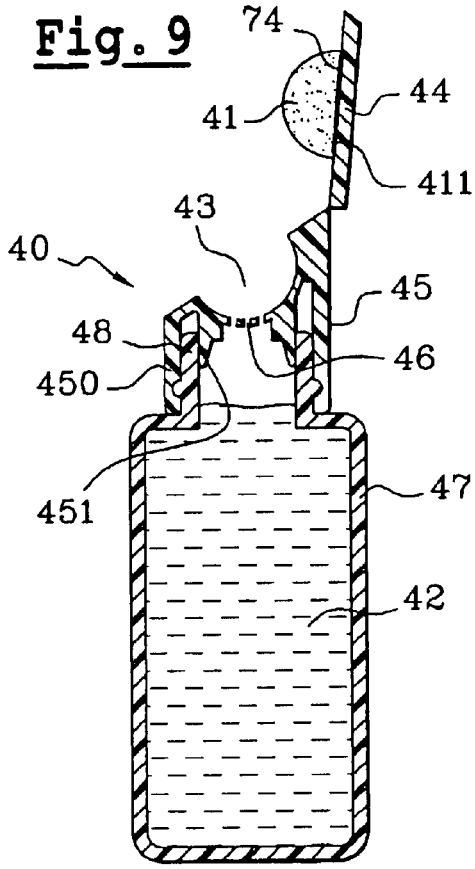
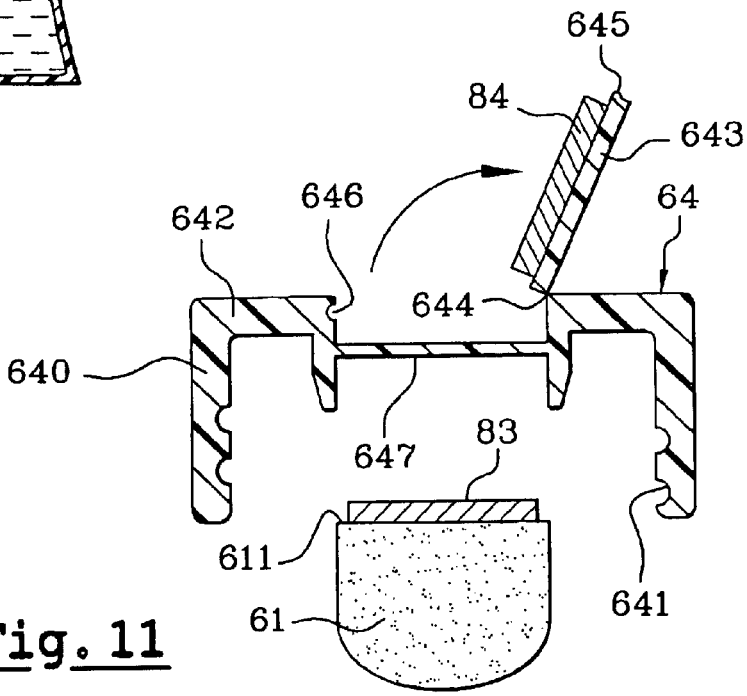
Fig. 11

DEVICE, SYSTEM, AND METHOD FOR APPLYING A PRODUCT

The present invention relates to a device for applying a product, for example, a cosmetic product (e.g., care products), which may include a removable application element. The invention also relates to systems and methods that include the device for applying a product.

Some applicators (e.g., applicators for applying cosmetic products) include application elements that may dry out and stiffen with repeated use. It may be desirable to be able to easily remove dried out and stiffened application elements, for example, in order to clean or replace them without substantially diminishing the overall effectiveness of the applicator.

In addition, it may be desirable to use various types of application elements, for example, having different application surfaces, depending, for example, on the part of the human anatomy to which the product is to be applied. One possible solution presently available, for example, is to use different applicators having different application elements.

U.S. Pat. No. 5,322,382 discloses a skin lotion applicator that may include an application element in the form of a sponge. The sponge may include an adhesive backing, which may enable it to be affixed to a portion of the applicator. The application element may be removed and re-bonded on the applicator. With such an applicator, the adhesive may remain primarily on the application element, and any new application element sponge must include an adhesive backing so that it can be fixed to the applicator. This may increase the cost of the application element sponges which can be used with the applicator. Moreover, in some applicators, the application element sponges may be bonded on a relatively resilient portion of the applicator, for example, a rubber membrane. When the sponge is removed (e.g., peeled off), the rubber membrane has a tendency to deform and/or stretch as the sponge is pulled away from the rubber membrane so that at the moment of detachment, the energy required to remove the sponge may be quite considerable and may cause a portion of the sponge to tear away and remain on the rubber membrane.

One example of an applicator is described in German utility model DE 200 13 013, which discloses a brush in which an applicator part may be bonded on a handle via two-sided tape. In order to affix another applicator part it may be necessary to use additional two-sided tape.

European patent application number EP A 0 680 706 describes a brush for applying adhesive or paint. The brush may include a sleeve at one end of which an application element including a tuft of fibers is removably affixed. Because the application element includes fibers, it is necessary to stabilize the fibers in order to form a brush, for example, by using a handle to hold the fibers and/or to bond the fibers to a base in the handle. The handle may be fitted in a removable way, for example, using a magnetized part on a sleeve.

One subject of the invention relates to providing a device that may overcome some problems associated with previous applicators. Another subject of the invention relates to providing a device that may enable various application elements to be used. Yet another subject of the invention relates to providing a device in which the application element may be more easily removed and in which either the same or different application elements may be used. A further subject of the invention relates to providing a device having an effectiveness that may not be substantially reduced as a result of, for example, removing one or more application elements numerous times. An additional subject of the invention relates to providing a device that may be simple to use.

In the following description, certain aspects and embodiments will become evident. It should be understood that the invention, in its broadest sense, could be practiced without having one or more features of these aspects and embodiments. It should be understood that these aspects and embodiments are merely exemplary.

In one aspect, as embodied and broadly described herein, the invention includes a device for applying a product. The device may include a first element configured to apply a product, a second element, and an adhesive removably affixing the first element to the second element. The adhesive may be configured to bond more securely to the second element than to the first element.

According to another aspect, a device for applying a product may include a first element configured to apply a product. The first element may at least partially include porous material. The device may include a second element, wherein the device is configured to removably affix the first element to the second element via magnetic attraction.

In still another aspect, one of the first and the second element may include an element configured to generate a magnetic field, and the other of the first element and the second element may include an element configured to be sensitive to a magnetic field. For example, a first element may include an application element having a magnetic plate and second element may include a gripping element having a plate configured to be magnetized, or vice versa.

According to another aspect, at least a portion of one of the first element and the second element may be configured to generate a magnetic field and at least a portion of the other of the first element and the second element may be configured to be sensitive to the magnetic field.

In an additional aspect, the first element may include one of a magnetic plate and a magnetizable plate, and the second element may include the other of a magnetic plate and a magnetizable plate.

According to another aspect, a device for applying a product may include a first element configured to apply a product. The first element may at least partially include porous material. The device may include a second element and a fixing element configured to removably affix the first element to the second element such that when the first element is separated from the second element, at least a substantial portion of the fixing element remains on the second element.

In another aspect, the fixing element may include an adhesive.

According to yet another aspect, the fixing element may include one of a magnetic element and a magnetizable element.

In another aspect, the first element may include one of a magnetic plate and a magnetizable plate, and the second element may include the other of a magnetic plate and a magnetizable plate.

According to some aspects, the first element may serve as an application element that may be relatively easily removed from the second element without being damaged. Moreover, the first element may be affixed to the second element again, for example, in substantially the same position.

In some aspects that include adhesive, by removably affixing the first element to the second element, the adhesive may bond more strongly to the second element so that if the first element is removed, substantially all of the adhesive remains on the second element. Another first application element (e.g., a new application element), which does not have an adhesive backing, may be removably affixed to the second element (e.g., with the adhesive that remained on the second element). Therefore, first elements, for example, replacement (e.g., substitute) application elements, that may have a reduced cost may be used, since they may lack an adhesive backing and/or a film to protect the adhesive backing.

In some aspects that include magnetic attraction, the first element may be detached and re-fixed for a substantially unlimited number of times, for example, due to the fact that magnetic attraction does not wear out with repeated use. Moreover, magnetic attraction may ensure a more secure attachment of the first element to the second element during application of product.

According to further aspect, the second element may include a gripping element. For example, a gripping element may be mounted to the second element.

The first element may be held on a second element having a gripping element or may be held on a gripping element in such a manner that the gripping element may be held during application of the product on a part of the human anatomy being treated. The first element may remain fixed on the second element, for example, if the first element is rubbed onto the part of the human anatomy being treated, while allowing while allowing the first element to be detached from the second element.

In another aspect, the second element may include at least one rigid portion, wherein the first element is removably affixed to the at least one rigid portion of the second element. For example, when the first element is pulled in order to remove it, the first element may become immediately detached from the second element (e.g., without requiring too much energy). If the first element had been fixed to a substantially non-rigid part, for example, as is the case of the applicator described in U.S. Pat. No. 5,322,382, the substantially non-rigid part would have a tendency to deform and/or stretch as the first element is pulled away from the substantially non-rigid part so that at the moment of detachment, the energy required to remove the first element may be quite considerable and may cause a portion of the first element to tear away and remain on the substantially non-rigid part. If, on the other hand, the first element were fixed on a rigid part, the detachment would be less severe so that the first element may remain intact.

According to another aspect, the first element may include an application surface and a face located substantially opposite to the application surface, wherein the face of the first element may be removably affixed to the second element. For example, the face of the first element may define a periphery and an adhesive may be located at least partially in an area located in the vicinity of the periphery of the face. The first element may be held over the entire periphery, which may improve its usefulness due, for example, to the manner in which the first element is affixed to the second element.

In still another aspect, the first element may define a height and the second element may include a barrel, and the first element may be located in the barrel such that at least a portion of the height of the first element is located within the barrel of the second element. The barrel may encompass the first element without being in contact with it (e.g., the barrel may be at least a relatively slight distance from the first element). The barrel may limit any movement of the base of the first element if, for example, the product is applied by rubbing the first element on the part of the human anatomy being treated. Alternatively, the barrel may contact the first element and may hold it laterally relative to the base of the first element.

According to a further aspect, the first element may include a lateral portion bonded to the barrel at at least one point on the barrel.

In yet another aspect, the adhesive may be in the form of at least one of a spot, a substantially straight line, a curve, a circle, and a shape substantially the same as that of a surface of at least one of the first element and the second element. Moreover, spots of adhesive or a line of adhesive may be applied on the internal wall of the barrel, for example, in order to bond the lateral edge of the first element to the barrel.

According to a further aspect, the adhesive may include at least one adhesive selected from permanent adhesives, acrylic adhesives, polyurethanes, vinyls, polyolefin type adhesives, solvents, and hot-melt type adhesives. A permanent adhesive may substantially retain its adhesive strength relatively permanently (e.g., over the course of time and/or a number of occasions in which the first element is separated and re-affixed to the second element via the adhesive).

In still another aspect, the adhesive may include a permanent adhesive configured for wet environments (e.g., adhesive strength is not substantially affected by a solvent contained in the product being applied).

According to another aspect, the first element may at least partially include porous material. For example, the first element may include at least one material selected from sintered materials, thermoplastic materials, ceramic materials, felts, elastically compressible materials, foams having closed cells, foams having open cells, foams having semi-open cells, and elastomers. The first element may include superimposed layers of the at least one material. The foams may include at least one material selected from materials based on polyurethanes, polyesters, polyethers, natural rubbers (NBRs), synthetic rubbers (SBRs), butyl rubbers, silicones, nitriles, and EPDMs (e.g., copolymers of a diene with ethylene and propylene).

First elements according to some aspects, may be used in association with any type of device for applying a product.

According to yet another aspect, the device may include a recess configured to receive the first element and the second element may include a closing element configured to close the recess of the device in a substantially tight sealing manner.

In still a further aspect, the second element may include a body defining a reservoir for containing a product, wherein the body may be associated with a recess and the first element may be removably affixed in the recess.

In still another aspect, a system for applying a product may include a device for applying a product, a reservoir, and a product contained in the reservoir. For example, the product may include a cosmetic product.

According to another aspect, the system may include a portion defining a recess. The recess may be in one of permanent and selective flow communication with an interior of the reservoir, and may be configured to receive the first element. The system may include a closing element configured to close the recess in a substantially tight manner. For example, the first element may be one of removably affixed in the recess and removably affixed on the closing element.

In still another aspect, the system may include a device for applying a product and at least one additional element configured to apply a product, wherein the first element may be configured to be removed from the second element such that the adhesive substantially remains on the second element, and the at least one additional element may be configured to be affixed to the second element via the adhesive remaining on the second element. According to another aspect, the at least one additional element may at least partially include porous material.

According to yet another aspect, a method of enabling replacement of a first element for applying a product may include providing the device for applying a product and removing the first element from the second element such that a substantial portion of the adhesive remains on the second element.

The term "providing" is used in a broad sense, and refers to, but is not limited to, making available for use, manufacturing, enabling usage, giving, supplying, obtaining, getting a hold of, acquiring, purchasing, selling, distributing, possessing, making ready for use, forming and/or obtaining intermediate product(s), and/or placing in a position ready for use.

In still another aspect, a method of enabling replacement of a first element for applying a product may include providing a replacement first element and affixing the replacement first element to the second element via the substantial portion of adhesive remaining on the second element.

According to another aspect, a method of applying a product may include providing the system for applying a product, loading the first element with the product, and applying the product with the first element. For example, the applying may include applying the product to an external body portion including at least one of hair, skin, and nails.

In yet another aspect, a method of enabling replacement of a first element for applying a product may include providing the device for applying a product, removing the first element from the second element, providing a replacement first element, and affixing the replacement first element to the second element via magnetic attraction.

According to still another aspect, a device for applying a product may include a first element configured to be removably affixed to a portion of a device for applying a product (e.g., a cosmetic product), wherein the first element may at least partially include porous material that may be at least one of configured to generate a magnetic field and configured to be sensitive to a magnetic field. For example, the first element may include one of a magnetic plate and a plate configured to be magnetized.

According to another aspect, the first element may be substantially loaded with the product to be applied, for example, if it is intended to be used in a device which does not include a reservoir (e.g., in a device configured to be used while traveling (e.g., single dose type)).

The invention according to some aspects may be used for applying cosmetic products, for example, cosmetic products including one or more of liquids, gels, creams, skin creams, care substances (e.g., skin, hair, and/or nail care substances), sunscreens, self-tanning lotions, make-up, eye-liners, tinted foundations, etc. The cosmetic products may also include solids, for example, sticks of product.

Aside from the structural and procedural arrangements set forth above, the invention could include a number of other arrangements, such as those explained hereinafter. It is to be understood, that both the foregoing description and the following description are exemplary.

The accompanying drawings are incorporated in and constitute a part of this specification. The drawings illustrate exemplary embodiments of the invention and, together with the description, serve to explain some principles of the invention. In the drawings, FIG. 1 is schematic partial section view of an embodiment of a device for applying a product;

FIG. 9 is schematic partial section view of a further embodiment of a device for applying a product;

FIG. 10 is schematic partial section view of another embodiment of a device for applying a product; and FIG. 11 schematic partial section view of a further embodiment of a device for applying a product.

Reference will now be made in detail to some possible embodiments of the invention, examples of which are illustrated in the accompanying drawings. Wherever possible, the same reference numbers are used in the drawings and the description to refer to the same or like parts.

Figure 1:
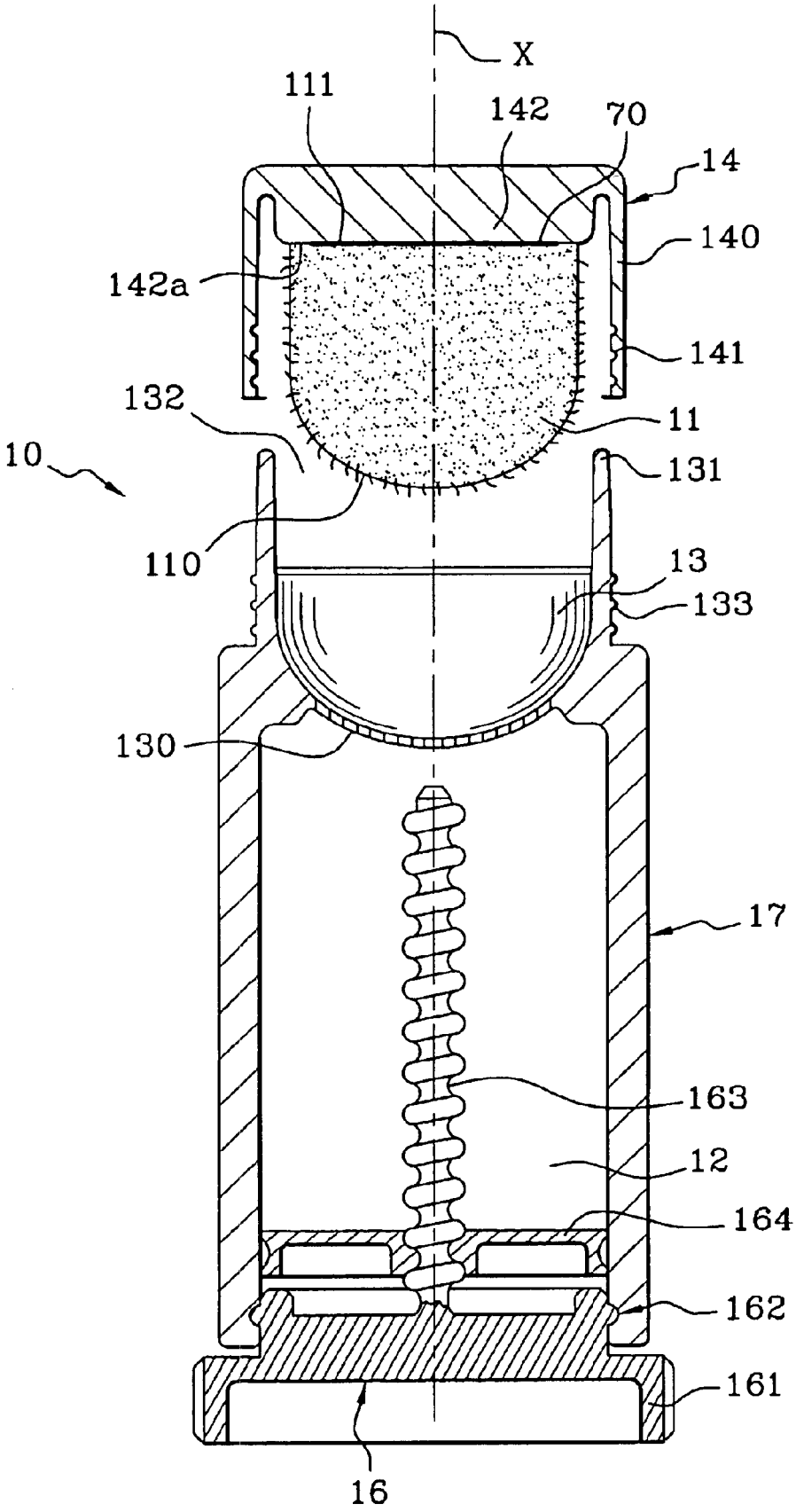

FIG. 1 depicts an exemplary embodiment of a device 10 that may include a body 17 (e.g., a cylindrical body) having a longitudinal axis X, and comprising, for example, polypropylene. The body 17 may substantially define a reservoir 12 for containing a product (e.g., a cosmetic product) and a recess 13 mounted on the reservoir 12 and being in flow communication with the reservoir 12. A member 14 (e.g., a stopper) on which an application element 11 may be removably affixed, may be configured to close in a substantially tight sealing manner the recess 13 in which the application element 11 may be positioned.

A lower portion of the reservoir 12 may be closed, for example, by a mechanism 16 that may be configured to reduce the internal volume of the reservoir 12 in order to move product toward the recess 13. The mechanism 16 may include, for example, an actuating wheel 161 that may be mounted (e.g., via a groove/rim arrangement 162) in a manner such that it can be rotated inside the reservoir 12. The wheel 161 may be substantially rigid and may include a threaded rod 163 configured to axially drive a threaded piston 164 that is substantially prevented from rotating inside the reservoir 12.

The upper part of the reservoir 12 may be closed, for example, by a wall 130 (e.g., a lateral wall) which may separate the reservoir 12 from the recess 13. The wall 130 may constitute a back portion of the recess 13. The wall 130 may have, for example, a hemispherical shape and may be in the form of grille and/or screen so as to allow product to pass from the reservoir 12 into the recess 13. One end of the recess 13 (e.g., opposite the wall 130) may form a free edge 131 defining an opening 132. The outside surface of the recess 13 may include a thread 133 configured to cooperate with a corresponding thread 141 that may be on the member 14 (e.g., a stopper).

At least a portion of the application element 11 may include, for example, porous material (e.g., an open-cell foam, for example, a block of open-cell natural rubber foam). The porous material may have, for example, a substantially hemispherical profile so as to substantially correspond with the hemispherical profile defined by the back of the recess 13 (e.g., when the recess 13 has a hemispherical shape). The surface of the application element 11 may be at least partially covered by a flocking 110. The application element 11 may include a base 111 that may be in the form a relatively planar surface.

The member 14 (e.g., a stopper) may include a mounting skirt 140 comprising a thread 141 so that the member 14 may be threaded onto the threaded neck of the recess 13 (e.g., when the neck of the recess includes a thread) and closed at one end by a wall 142 (e.g., a lateral wall). The application element 11 may be bonded, for example, via an adhesive 70, to the internal face 142*a* of the wall 142 of the member 14. For example, the internal face 142*a* may be a substantially planar and relatively smooth surface. In a fixed position, the application element 11 may contact the mounting skirt 140 so that the application element 11 may be contacted with the skin. The member 14 may be configured to serve as a gripping element for the application element 11.

Figure 2:
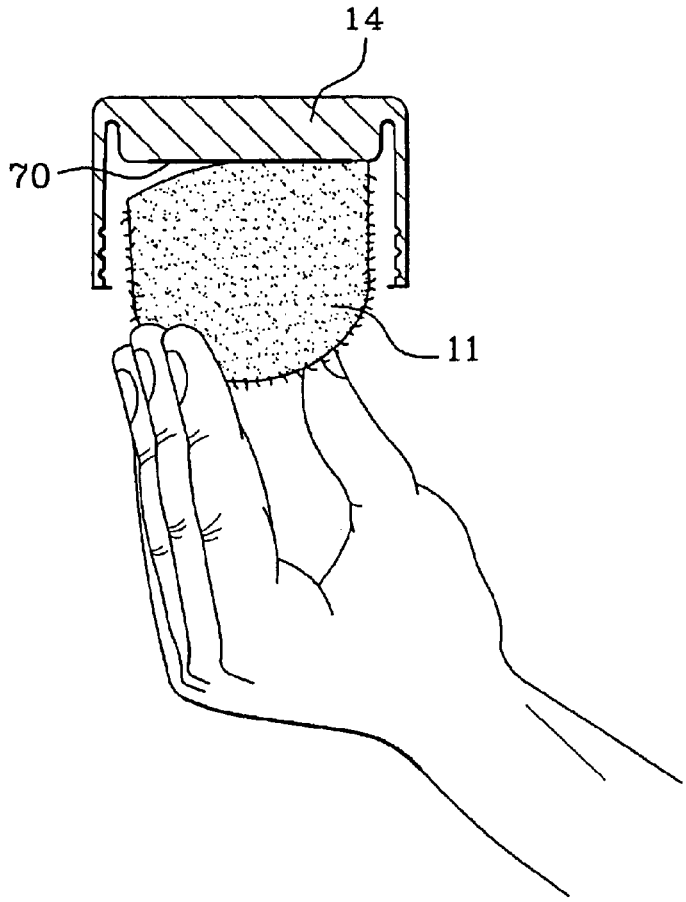
FIG. 2 is a schematic partial section view of a portion of the device depicted in FIG. 1.
Figure 4A:
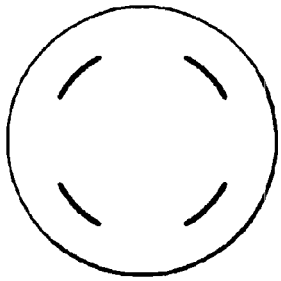
FIG. 4A is schematic plan view of an embodiment of an element of a device for applying a product.
Figure 4B:
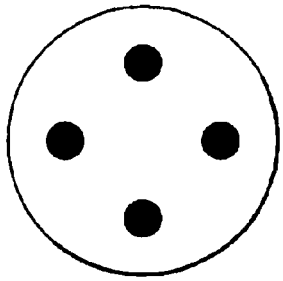
FIG. 4B is schematic plan view of another embodiment of an element of a device for applying a product.
Figure 4C:
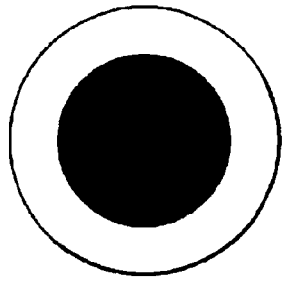
FIG. 4C is schematic plan view of a further embodiment of an element of a device for applying a product.
Figure 4D:
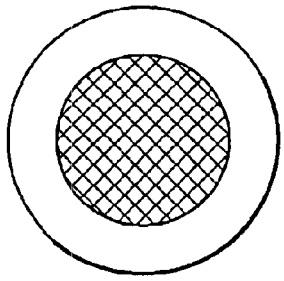
FIG. 4D is schematic plan view of another embodiment of an element of a device for applying a product.

In some embodiments that include adhesive, the adhesive 70 may be applied in a manner that defines various and numerous configurations. For example, the adhesive may define a shape substantially the same as the shape of the internal face 142*a* of the wall 142 of the member 14, for example, a circular shape as shown in FIG. 4C. An acrylic adhesive may be spread on the internal face 142*a* of the wall 142 and may then adhere to the face 111 of the application element 11. When the application element 11 is pulled away from the member 14, as shown in FIG. 2, the adhesive 70 may substantially remain on the internal face 142*a* of the wall 142 of the member 14. The application element 11 may then be changed with another application element, for example, having a different texture, which may be removably affixed to the member 14 since at least a substantial portion of the adhesive 70 still remains on the face 142*a*. The first application element 11 may then be re-positioned for use at another time.

Figure 3:
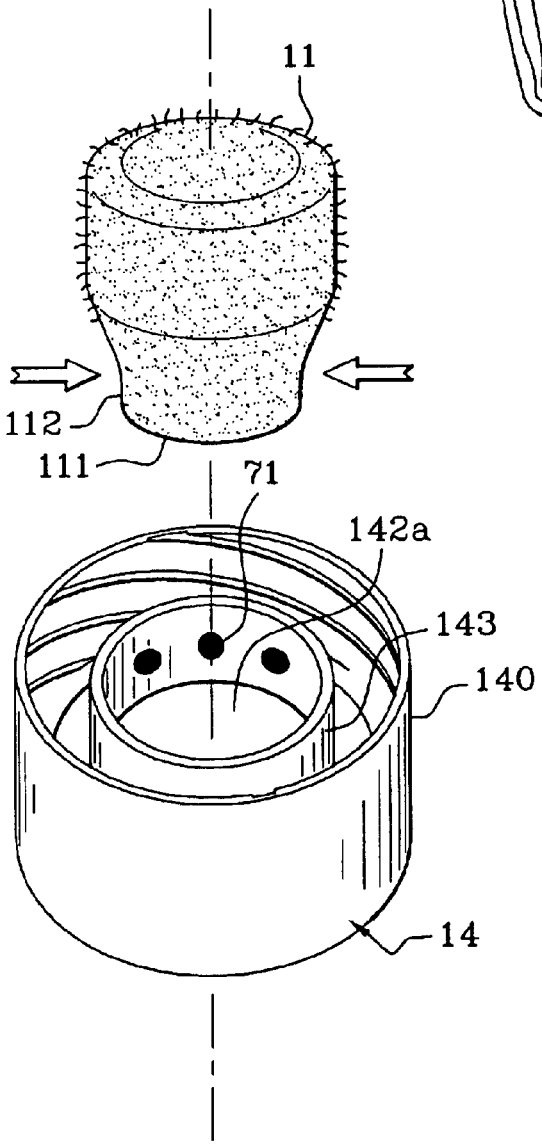
FIG. 3 is a perspective view of a portion of another embodiment of a device for applying a product.

The exemplary embodiment depicted in FIG. 3 may include an internal face 142*a* of the wall 142 of the member 14 that may comprise a barrel 143 (e.g., an axial barrel), the diameter of which may be substantially equal to that of the base of the application element 11. The barrel 143 may be configured to laterally hold the application element 11 in the member 14. In such a configuration, for example, the application element 11 may be capable of being fixed on the member 14 via its lateral edge 112, which may be configured to contact the barrel 143. For example, spots 71 of adhesive may be applied to the internal surface of the barrel 143. To position the application element 11 on the member 14, it may be compressed laterally, as shown in FIG. 3, in order to insert the application element 11 into the barrel 143. On releasing the application element 11, its lateral edge 112 may contact the barrel 143. According to this exemplary embodiment, adhesive may only be applied on the internal surface of the barrel 143 and/or only on the internal face 142*a* of the wall 142 of the member 14.

Figure 4E:
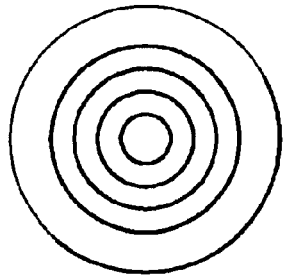
FIG. 4E is schematic plan view of a further embodiment of an element of a device for applying a product.

FIGS. 4A through 4E depict numerous exemplary ways to distribute the adhesive 70 on the member 14. The adhesive 70 may be distributed on the member 14 in a manner such that the adhesive forms sections (FIG. 4A), spots (FIG. 4B), a shape substantially the same as that of a surface of the internal wall 142*a* (FIG. 4C), squares (FIG. 4D), and/or circumscribed circles (FIG. 4E).

In some exemplary embodiments, one or more additional application elements 11 may be supplied separately, and/or in addition to, an application element 11 initially associated with the device 10 (e.g., in the form of application elements for replacing the initial application element). In one example, the additional application elements may be configured to alter the application characteristics of the device 10.

Figure 5:
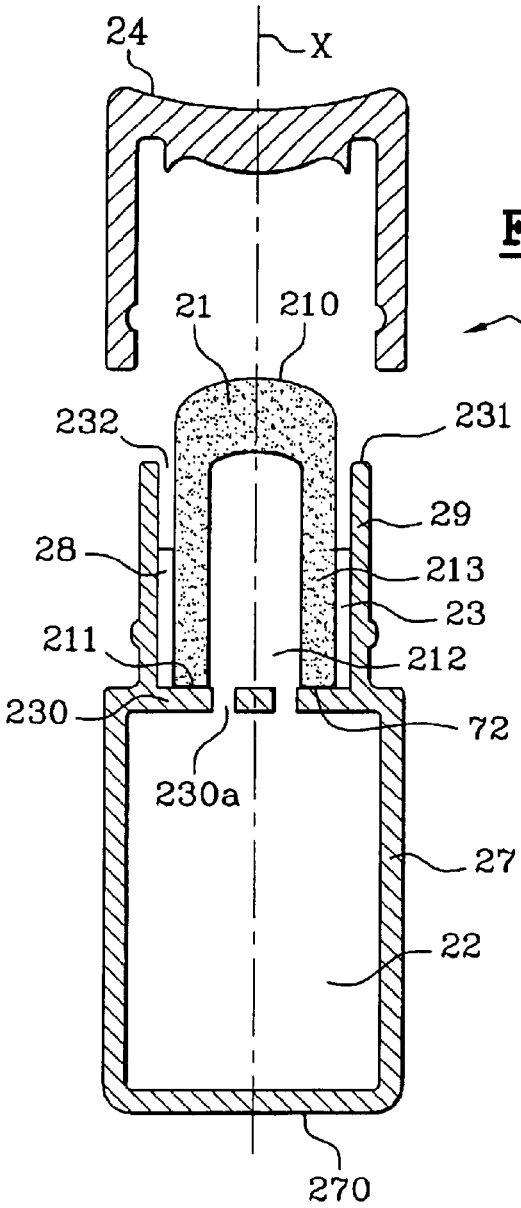
FIG. 5 is schematic partial section view of another embodiment of a device for applying a product.

FIG. 5 depicts an exemplary embodiment of a device 20 (e.g., a flask applicator) that may include a reservoir 22 including a body 27. One end of the body 27 may be substantially closed by a bottom 270. The other end of the reservoir 22 may terminate in a neck 29, on which a member 24 (e.g., a stopper) may be removably mounted. The member 24 may be configured to close (e.g., with a substantially tight seal) an opening 232 defined by the free edge 231 of the neck 29. The neck 29 may define an internal recess 23 (e.g., a cylinder of rotation around a longitudinal axis X). The bottom of the recess 23 may be delimited by a wall 230 (e.g., a lateral wall) which may include passages 230*a* (e.g., capillary passages) configured to absorb a portion of product via capillary action, and on which the application element 21 may be fixed, for example, via a vinyl adhesive 72. Grooves 28 may be provided to laterally hold a lower portion of the application element 21. The body 27 may serve as gripping element for the application element 21.

The application element 21 may at least partially include porous material, for example, resilient foam and/or polyurethane foam, and may include, for example, a substantially dome-shaped application surface 210. A lower portion 213 of the application element 21 may be positioned inside a recess 212 and may open out toward the reservoir 22. The lower portion 213 may terminate in a substantially planar annular surface 211, which may be affixed to the lateral wall 230 of the internal recess 23. When the member 24 is in the open position, for example, the application surface 210 may contact the free edge 231 of the neck 29, and when the member 24 is in the closed position, the application element 21 (e.g., foam application element) may be compressed inside the recess 23. If the member 24 is removed, the application element 21 may expand and may absorb a portion of the product via capillary action through the capillary passages 230*a*. The product may be placed in contact with the applicator element 21, for example, by substantially inverting the device 20, shaking it, and/or by movements occurring in a handbag (e.g., movements due to by carrying the device 20 in the handbag).

Figure 6:
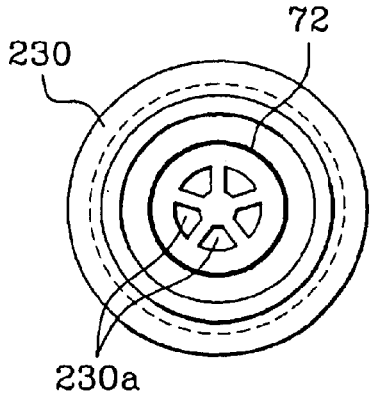
FIG. 6 is a schematic plan view of a portion of the embodiment of the device depicted in FIG. 5.

FIG. 6 depicts adhesive applied in the form of a circular bead 72. For example, the bead of adhesive 72 may be relatively narrow and may not cover substantially all the cells of foam (e.g., when the application element 21 at least partially comprises foam) so that the cells can absorb the product. The adhesive may bond to the wall 230 of the recess 23 well enough so that if the application element 21 is separated from the wall 230, substantially all the adhesive remains on the wall 230 (as opposed to the application element 21).

Figure 7:
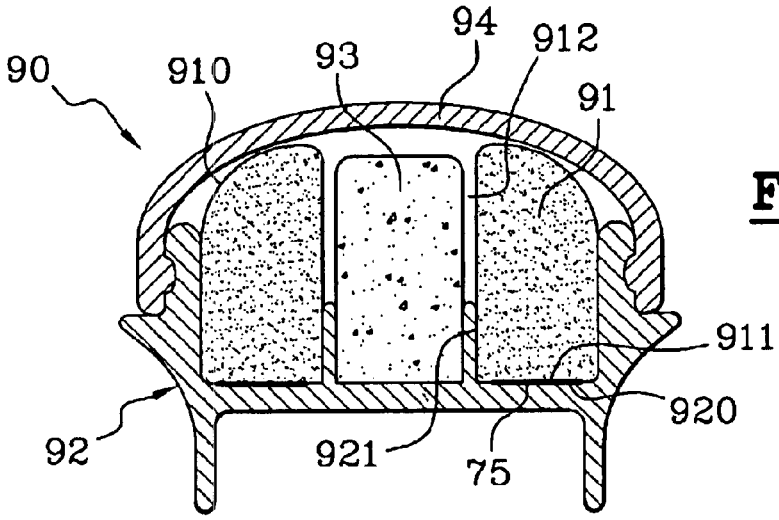
FIG. 7 is schematic partial section view of a further embodiment of a device for applying a product.

FIG. 7 depicts an exemplary embodiment of a device 90 that may include a base 92 that defines an open recess that may be closed in a reversible manner, for example, via a cap 94. The base 92 may include wall 920 (e.g., a lateral wall) substantially defining the back of the recess. A barrel 921 (e.g., axial barrel) may extend from the wall 920 and along with a substantially corresponding portion of the wall 920, may substantially define a cup configured to receive a portion of product 93 (e.g., a stick of cosmetic product (e.g., a tinting foundation)). The portion of product 93 may be held inside the cup, for example, via lateral pressure and/or friction fit.

The device 90 may include an application element 91 that may at least partially comprise porous material (e.g., a foam material (e.g., a block of foam material)) that may be traversed by a recess 912 (e.g., an axial, cylindrical recess) which extends substantially the axial height of the application element 91. The recess 912 may open out via an orifice formed, for example, in the center of an application surface 910 of the application element 91. Opposite the application surface 910, the application element 91 may comprise a substantially planar surface 911 (e.g., an annular, planar surface). The surface 911 of the application element 91 may be removably affixed via, for example, acrylic adhesive 75, to the wall 920 of the base 92, around the cap 94, in such a way as to encompass the stick of product 93. The stick of product 93 may be held inside the recess 912 defined by the application element 91, and a free surface of the stick of product 93 may be located below the application surface 910.

In order to apply product, the applicator 90 may be applied on the skin, which may cause compression (at least partially) of the application element 91 until the free surface of the stick of product 93 is generally level with the application surface 910. The stick of product 93 may then contact the skin, and the application surface 910 may enable a good distribution of the product onto the skin. The product may then be toned down, for example, using the application surface 910. If the user wishes to change the application element 91, the user may remove application element 91 with a substantial portion of the adhesive 75 remaining bonded on the wall 920 of the base 92. The user may then removably affix a new application element to the wall 920 using the adhesive 75 remaining on the wall 920.

Figure 8:
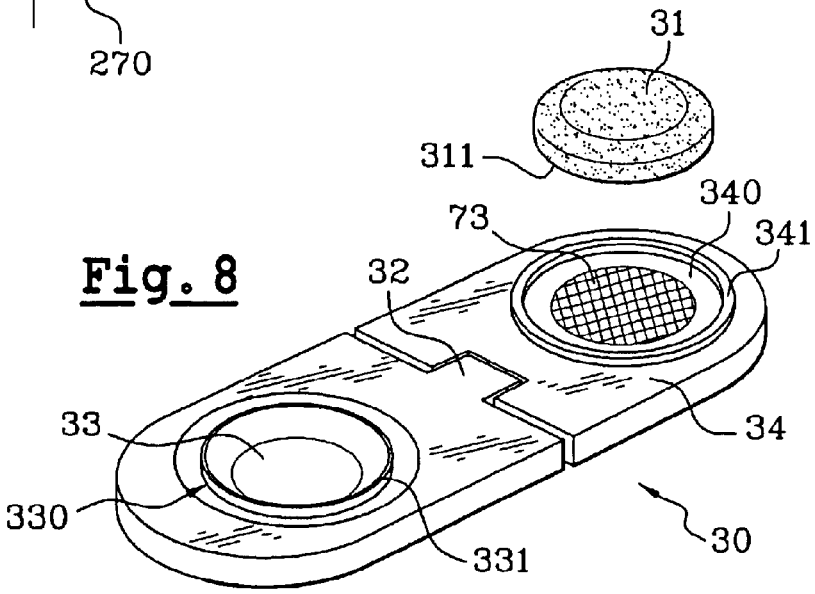
FIG. 8 is schematic partial section view of another embodiment of a device for applying a product.

FIG. 8 depicts an exemplary embodiment of a device 30 that may include a box comprising a receptacle 330 in which an open recess 33 may be defined. A cap 34 may be provided to close the recess 33 in a substantially tight sealing manner, for example, so as to define a closed volume. The receptacle 330 and the cap 34 may be linked by a hinge 32, which may be of any type (e.g., a flush pin hinge type). An application element 31 may at least partially include porous material (e.g., a polyester foam) and may be removably affixed on the internal wall 340 of the cap 34 (e.g., on the wall intended to face the receptacle 330). The application element 31 may include a block of foam having a substantially circular cross-section and may include an application face which is, for example, concave. The block of foam may have a substantially planar base 311. The application element 31 may be pre-impregnated with product, and the shape of the recess 33 may be generally complementary to that of the application element 31. The recess 33 may include an annular wall 331, for example, in such a manner as to form a sealing channel. The cap 34 may include an annular wall 341 configured to be located around the application element 31 and to fit within the sealing channel of the recess 33 when the cap 34 is in the closed position.

The application element 31 may be bonded to the cap 34 with adhesive 73. The adhesive 73 may be an adhesive of the polyolefin type and may be initially applied to the internal wall 340 of the cap 34. The adhesive 73 may be distributed, for example, in the form of squares on a section generally corresponding to the shape of the face 311 of the application element 31, which may be bonded to the cap 34. When the application element 31 is removed, at least a substantial portion of the adhesive 73 remains on the internal wall 340 of the cap 34.

FIG. 9 depicts an exemplary embodiment of a device that may include a body 47 substantially defining a reservoir 42 and a head 45, which may be mounted on the body 47, thereby defining a recess 43 in which an application element 41 may be held.

The back of the recess 43 may include one or more orifices 46 in flow communication with the inside of the body 47. The head 45 may include a mounting skirt 450 configured to, for example, ratchet onto a neck 48 of the reservoir 42 (e.g., which may be one piece with the body 47) and a sealing lip 451, which may create a substantially tight seal between the head 45 and the body 47, for example, in order to ensure substantially sealed flow communication between the orifices 46 and the inside of the body 47 (e.g., the reservoir 42). The body 47 may include a relatively flexible wall, for example, so as to allow the user, by pressing on the flexible wall, to force the product into the orifices 46.

The application element 41 may be removably affixed, for example, via an adhesive 74, to a support element 44, which may form a cap joined with the head 45 via, for example, a film hinge. The support element 44 may include a sealing lip (not shown) which may create a substantially tight seal with the head 45, for example, if the support element 44 is in a closed position, in such a way as to close the recess 43 with a substantially hermetic seal.

The application element 41 may at least partially comprise porous material (e.g., butyl rubber foam). The application element 41 may include a substantially dome-shaped application surface (e.g., that may be roughened) and a substantially planar surface 411, which may be removably affixed to an internal face of the support element 44. The adhesive 74 may be an adhesive comprising a vinyl type adhesive and may be initially applied to the support element 44, for example, in the form of circumscribed circles, as shown in FIG. 4E. When the application element 41 is removed from the support element 44, substantially all of the adhesive 74 may remain on the cap 44.

FIG. 10 and FIG. 11 depict exemplary embodiments of a device for applying a product in which the application element may be removably affixed via magnetic attraction.

FIG. 10 depicts a device 50 that may include a reservoir 52 (e.g., a tube having flexible walls 57). The reservoir 52 may terminate, for example, in a neck 533 (e.g., a threaded neck) that may allow a member for closing the reservoir (e.g., a stopper) to be removably mounted with a substantially tight seal, on an opening 532 substantially defined by the free edge 531 of the neck 33. The internal wall of the neck 533 may define an internal cylindrical recess 53. An annular protrusion 534 may be included at the bottom of the recess 53 on which a plate 81 (e.g., a magnetic plate and/or a magnetizable plate) may be removably affixed (e.g., via adhesion, for example, via a plate comprising thermoplastic material containing ferrite and/or rare earth particles). In some embodiments, the plate 81 may be mounted on the bottom of the recess 53 in another manner, for example, via ratcheting. The plate 81 may include an orifice 810 allowing product to pass between the reservoir 52 and the recess 53.

An application element 51 (e.g., in cylindrical form) may be configured to be held in the recess 53. The application element 51 may include, for example, a sintered material (e.g., a ceramic material). The application element 51 may include a base 511 comprising a substantially planar surface and an application surface 510 (e.g., a substantially dome-shaped application surface). When the application element 51 is mounted in the recess 53, it may extend beyond the free edge 531 of the neck 533 so as to enable the application surface 510 to contact the skin. The reservoir 52 may then be used as a gripping element of the application element 51, and the product may be forced into the application element 51 via pressing the flexible walls (e.g., when the reservoir comprises a tube having flexible walls). A plate 82 (e.g., circular plate) which may be magnetic and/or magnetizable may be fixed on the base 511 of the application element 51, for example, via adhesion or by any other type of removable fixing which may be capable of holding the plate 82 relatively securely on the application element 51 (e.g., in the event that the magnetic attraction between the two plates 81 and 82 has to be broken or significantly reduced). The plate 82 may include an orifice 820, which may be positioned facing toward an orifice 810 that may be included in the plate 81. The application element 51 may therefore be removably affixed on protrusion 534 of the recess 53 via magnetic attraction, with the plate 82 of the application element 51 contacting the plate 81 of the bottom of the recess 53. If a user desires to remove the application element 51 from the device 50, the application element 51 may be gripped, for example, by a portion of the application element 51 extending beyond the neck 533, and the two plates 81 and 82 may be pulled away from each other in order to break the magnetic attraction.

FIG. 11 depicts an exemplary embodiment of a device 64 (e.g., a stopper) that may be used, for example, in association with an applicator such as described with reference to FIG. 1. The application element 61 be removably affixed to the device 64 via magnetic attraction instead of mechanical adhesion.

The device 64 may include a mounting skirt 640 comprising, for example, a threading 641 on its internal wall and a lateral wall 642. The lateral wall 642 may include a removable portion 643. The removable portion 643 may be articulated in relation to the remainder of the device 64, for example, around a hinge 644 (e.g., a film hinge). Alternatively, the removable portion 643 may be arranged so that it is completely detached from the rest of the device 64. Opposite the hinge 644, the lateral wall 642 may include a catch 646 substantially corresponding to a catch 645 that may be included on the removable portion 643 to hold the removable portion 643 in the closed position. The removable portion 643 may include, for example, on its internal wall, a magnet 84 affixed via adhesion and/or any other manner of affixing. The lateral wall 642 may include an annular portion 647 arranged to face toward the removable wall 643.

The application element 61 may at least partially include porous material (e.g., sintered material, for example, thermoplastic material). A base 611 of the application element 61 may include a plate 83 (e.g., a magnetic and/or magnetizable plate, for example, a plate including tinplate) bonded via adhesion to the application element 61 (or by any other manner of affixing which may hold the plate 83 rigidly on the application element 61), even in the event that the magnetic attraction between the magnet 84 and the plate 83 has been broken. The plate 83 may have a diameter slightly less than an inside diameter defined by the annular portion 647 of the lateral wall 642 of the device 64, such that the plate 83 may be inserted into the annular portion 647 and contact the magnet 84. The application element 61 may have a diameter slightly greater than that defined by the annular portion 647, and the periphery of the application element 61 may be pushed against the annular portion 647.

When the removable portion 643 is in the closed position, for example, the magnet 84 may be positioned at the bottom of the device 64. The base of the application element 61 may be substantially covered by the plate 83 and may be held in place via magnetic attraction. If the user desires to change the application element 61, the user may open the removable portion 643 of the device 64, as shown in FIG. 11, for example, with one hand, while holding the application element 61 in the other hand. The application element 61 may be separated from the removable portion 643, for example, by pushing against the annular portion 647.

In some exemplary embodiments, the application element may be supplied separately, for example, in the form of a replacement (e.g., substitute) application element. In addition, in some exemplary embodiments which may include a reservoir for containing product, any known techniques and/or structures may be employed to convey product from the reservoir.

The device according to some exemplary embodiments of the invention may be used to apply cosmetic products, such as care products, make-up products, dermatological substances, and/or pharmaceutical compositions used for treating and/or changing the appearance of, for example, hair, skin, and/or nails. However, in its broadest aspects, the present invention could be used to apply many other products.

Furthermore, sizes and configurations of various structural parts and materials used to make the above-mentioned parts are illustrative and exemplary only, and one of ordinary skill in the art would recognize that these sizes, configurations and materials can be changed to produce different effects or desired characteristics. For example, the application element may be in cylindrical, conical, or prismatic form, and may present circular, oval, rectangular, or polygonal cross-sections, or any combinations thereof. The face of the application element, which may be removably affixed, may be substantially planar, concave, or convex.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A device for applying a product, the device comprising:

a first element configured to apply a product;

a second element; and an adhesive removably affixing the first element to the second element, the adhesive being configured to bond more securely to the second element than to the first element, wherein the first element at least partially comprises a porous material.

2. The device of claim 1, wherein the second element comprises a gripping element.

3. The device of claim 1, further comprising a gripping element mounted to the second element.

4. The device of claim 1, wherein the second element comprises at least one rigid portion, wherein the first element is removably affixed to the at least one rigid portion of the second element.

5. The device of claim 1, wherein the first element comprises an application surface and a face located substantially opposite to the application surface, wherein the face of the first element is removably affixed to the second element.

6. The device of claim 5, wherein the face of the first element defines a periphery and the adhesive is located at least partially in an area located in the vicinity of the periphery of the face.

7. The device of claim 1, wherein the first element defines a height and the second element comprises a barrel, and wherein the first element is located in the barrel such that at least a portion of the height of the first element is located within the barrel of the second element.

8. The device of claim 7, wherein the first element comprises a lateral portion bonded to the barrel at at least one point on the barrel.

9. The device of claim 1, wherein the adhesive is in the form of at least one of a spot, a substantially straight line, a curve, a circle, and a shape substantially the same as that of a surface of at least one of the first element and the second element.

10. The device of claim 1, wherein the adhesive comprises at least one adhesive selected from permanent adhesives, acrylic adhesives, polyurethanes, vinyls, polyolefin type adhesives, solvents, and hot-melt type adhesives.

11. The device of claim 10, wherein the adhesive comprises a permanent adhesive configured for wet environments.

12. The device of claim 1, wherein the first element comprises at least one material selected from sintered materials, thermoplastic materials, ceramic materials, felts, elastically compressible materials, foams having closed cells, foams having open cells, foams having semi-open cells, and elastomers.

13. The device of claim 12, wherein the first element comprises superimposed layers of the at least one material.

14. The device of claim 1, wherein the device further comprises a recess configured to receive the first element and the second element comprises a closing element configured to close the recess of the device in a substantially tight sealing manner.

15. The device of claim 1, wherein the second element comprises a body defining a reservoir for containing a product, wherein the body is associated with a recess and the first element is removably affixed in the recess.

16. A system for applying a product, the system comprising:

the device of claim 1;

a reservoir; and a product contained in the reservoir.

17. The system of claim 16, wherein the product comprises a cosmetic product.

18. The system of claim 16, further comprising a portion defining a recess, the recess being in one of permanent and selective flow communication with an interior of the reservoir, the recess being configured to receive the first element, and a closing element configured to close the recess in a substantially tight manner.

19. The system of claim 18, wherein the first element is one of removably affixed in the recess and removably affixed on the closing element.

20. A method of applying a product, the method comprising:

providing the system of claim 16;

loading the first element with the product; and applying the product with the first element.

21. The method of claim 20, wherein the applying comprises applying the product to an external body portion comprising at least one of hair, skin, and nails.

22. A system for applying a product, the system comprising:

the device of claim 1; and at least one additional element configured to apply a product, wherein the first element is configured to be removed from the second element such that the adhesive substantially remains on the second element, and the at least one additional element is configured to be affixed to the second element via the adhesive remaining on the second element.

23. The system of claim 22, wherein the at least one additional element at least partially comprises porous material.

24. A method of enabling replacement of a first element for applying a product, the method comprising:

providing the device of claim 1; and removing the first element from the second element such that a substantial portion of the adhesive remains on the second element.

25. The method of claim 24, further comprising providing a replacement first element and affixing the replacement first element to the second element via the substantial portion of adhesive remaining on the second element.

26. A device for applying a cosmetic product, the device comprising:

a first element configured to apply a cosmetic product, the first element at least partially comprising porous material;

a second element; and a fixing element configured to removably affix the first element to the second element such that when the first element is separated from the second element, at least a substantial portion of the fixing element remains on the second element, wherein the fixing element comprises an adhesive.

27. The device of claim 26, wherein the second element comprises at least one rigid portion, wherein the first element is removably affixed to the at least one rigid portion of the second element.

28. The device of claim 26, wherein the first element comprises an application surface and a face located substantially opposite to the application surface, wherein the face of the first element is removably affixed to the second element.

29. The device of claim 26, wherein the device further comprises a recess configured to receive the first element and the second element comprises a closing element configured to close the recess of the device in a substantially tight sealing manner.

30. The device of claim 26, wherein the second element comprises a body defining a reservoir for containing a product, wherein the body is associated with a recess and the first element is removably affixed in the recess.

31. A system for applying a product, the system comprising:

a device for applying a product, the device comprising a first element configured to apply a product, the first element at least partially comprising porous material, a second element, and a fixing element configured to removably affix the first element to the second element such that when the first element is separated from the second element, at least a substantial portion of the fixing element remains on the second element;

a reservoir; and a product contained in the reservoir, wherein the product comprises a cosmetic product.

32. The system of claim 31, further comprising a portion defining a recess, the recess being in one of permanent and selective flow communication with an interior of the reservoir, the recess being configured to receive the first element, and a closing element configured to close the recess in a substantially tight manner.

33. The system of claim 32, wherein the first element is one of removably affixed in the recess and removably affixed on the closing element.

34. A method of applying a product, the method comprising:

providing the system of claim 31;

loading the first element with the product; and applying the product with the first element.

35. The method of claim 34, wherein the applying comprises applying the product to an external body portion comprising at least one of hair, skin, and nails.

36. A system for applying a product, the system comprising:

a product;

a first element loaded with the product, the first element being configured to apply the product via contact with a surface of the first element;

a second element; and an adhesive removably affixing the first element to the second element, the adhesive being configured to bond more securely to the second element than to the first element.

37. A device for applying a product, the device comprising:

a first element configured to apply a product;

a second element formed of a non-porous material; and an adhesive removably affixing the first element to the second element, the adhesive being configured to bond more securely to the second element than to the first element.

* * * * *